US011516571B2

(12) United States Patent
Huang et al.

(10) Patent No.: US 11,516,571 B2
(45) Date of Patent: Nov. 29, 2022

(54) HEADPHONE

(71) Applicant: MERRY ELECTRONICS CO., LTD., Taichung (TW)

(72) Inventors: Chih-Yuan Huang, Taichung (TW); Yung-Tsung Hsu, Taichung (TW); I-Chang Liu, Taichung (TW)

(73) Assignee: MERRY ELECTRONICS CO., LTD., Taichung (TW)

( * ) Notice: Subject to any disclaimer, the term of this patent is extended or adjusted under 35 U.S.C. 154(b) by 0 days.

(21) Appl. No.: 17/445,404

(22) Filed: Aug. 19, 2021

(65) Prior Publication Data

US 2022/0337932 A1 Oct. 20, 2022

(30) Foreign Application Priority Data

Apr. 20, 2021 (TW) ..... TW110114208

(51) Int. Cl.
*H04R 25/00* (2006.01)
*H04R 1/10* (2006.01)

(52) U.S. Cl.
CPC ..... *H04R 1/1008* (2013.01)

(58) Field of Classification Search
CPC .... H04R 1/1016; H04R 1/1041; H04R 1/105; H04R 1/08; H04R 1/1058; H04R 1/023; H04R 1/1025
See application file for complete search history.

(56) References Cited

U.S. PATENT DOCUMENTS 3,681,540 A * 8/1972 Thomson ..... H04R 5/0335 381/374
2021/0281939 A1* 9/2021 Yuen ..... H04R 1/105

* cited by examiner

*Primary Examiner* — Amir H Etesam
(74) *Attorney, Agent, or Firm* — CKC & Partners Co., LLC

(57) ABSTRACT

A headphone includes two audio output devices and a headband connected between the two audio output devices. The headband includes a rubber block and at least one shape memory alloy wire. The shape memory alloy wire is at least partially embedded in the rubber block. The rubber block has at least one cutout.

9 Claims, 6 Drawing Sheets

HEADPHONE

RELATED APPLICATIONS

This application claims priority to Taiwan Application Serial Number 110114208, filed Apr. 20, 2021, the disclosure of which is incorporated herein by reference in its entirety.

BACKGROUND

Technical Field

The present disclosure relates to a headphone.

Description of Related Art

Some headphones are designed to be twistable to make it more useful in use cases such as storage or gaming. However, the structural designs of the headbands of the commercially available headphones cannot provide desirable twist range, restoration force and wearing comfort at the same time.

SUMMARY

In view of the foregoing, one of the objects of the present disclosure is to provide a headphone with a headband that can provide desirable twist range, restoration force and wearing comfort.

To achieve the objective stated above, in accordance with an embodiment of the present disclosure, a headphone includes two audio output devices and a headband connected between the two audio output devices. The headband includes a rubber block and at least one shape memory alloy wire. The shape memory alloy wire is at least partially embedded in the rubber block. The rubber block has at least one first cutout.

In one or more embodiments of the present disclosure, the rubber block has a plurality of first cutouts. The first cutouts are arranged symmetrically along a first edge and a second edge of the rubber block. The second edge of the rubber block is opposite to the first edge of the rubber block.

In one or more embodiments of the present disclosure, the at least one shape memory alloy wire includes a first shape memory alloy wire and a second shape memory alloy wire. The first shape memory alloy wire passes through one or more of the first cutouts at the first edge. The second shape memory alloy wire passes through one or more of the first cutouts at the second edge.

In one or more embodiments of the present disclosure, each of the first cutouts has two side surfaces and a bottom surface connected between the two side surfaces. The first and second shape memory alloy wires pass through the two side surfaces and are spaced apart from the bottom surface.

In one or more embodiments of the present disclosure, the rubber block further has a second cutout. The second cutout is formed on a surface of the rubber block between the first edge and the second edge.

In one or more embodiments of the present disclosure, the headband further includes an arm. The arm includes a post. The shape memory alloy wire includes a curled portion exterior to the rubber block and fixedly wound on the post.

In one or more embodiments of the present disclosure, the rubber block includes a protrusion fixedly inserted into the arm.

In one or more embodiments of the present disclosure, the arm includes a first housing component and a second housing component. The protrusion of the rubber block is clamped by the first and second housing components.

In one or more embodiments of the present disclosure, the headphone further includes an electrical wire. The rubber block further has a groove. The groove is located on a surface of the rubber block facing the two audio output devices. The electrical wire is disposed in the groove.

In one or more embodiments of the present disclosure, the rubber block includes a retaining structure extending across the groove.

In sum, the headphone of the present disclosure is featured with a headband including a rubber block and at least one shape memory alloy wire at least partially embedded in the rubber block. This arrangement can provide advantages such as making the headband more easily twistable and restorable, and reducing the pressure applied to the user's head by the headphone to improve wearing comfort.

BRIEF DESCRIPTION OF THE DRAWINGS

To make the objectives, features, advantages, and embodiments of the present disclosure, including those mentioned above and others, more comprehensible, descriptions of the accompanying drawings are provided as follows.

DETAILED DESCRIPTION

Figure 1:
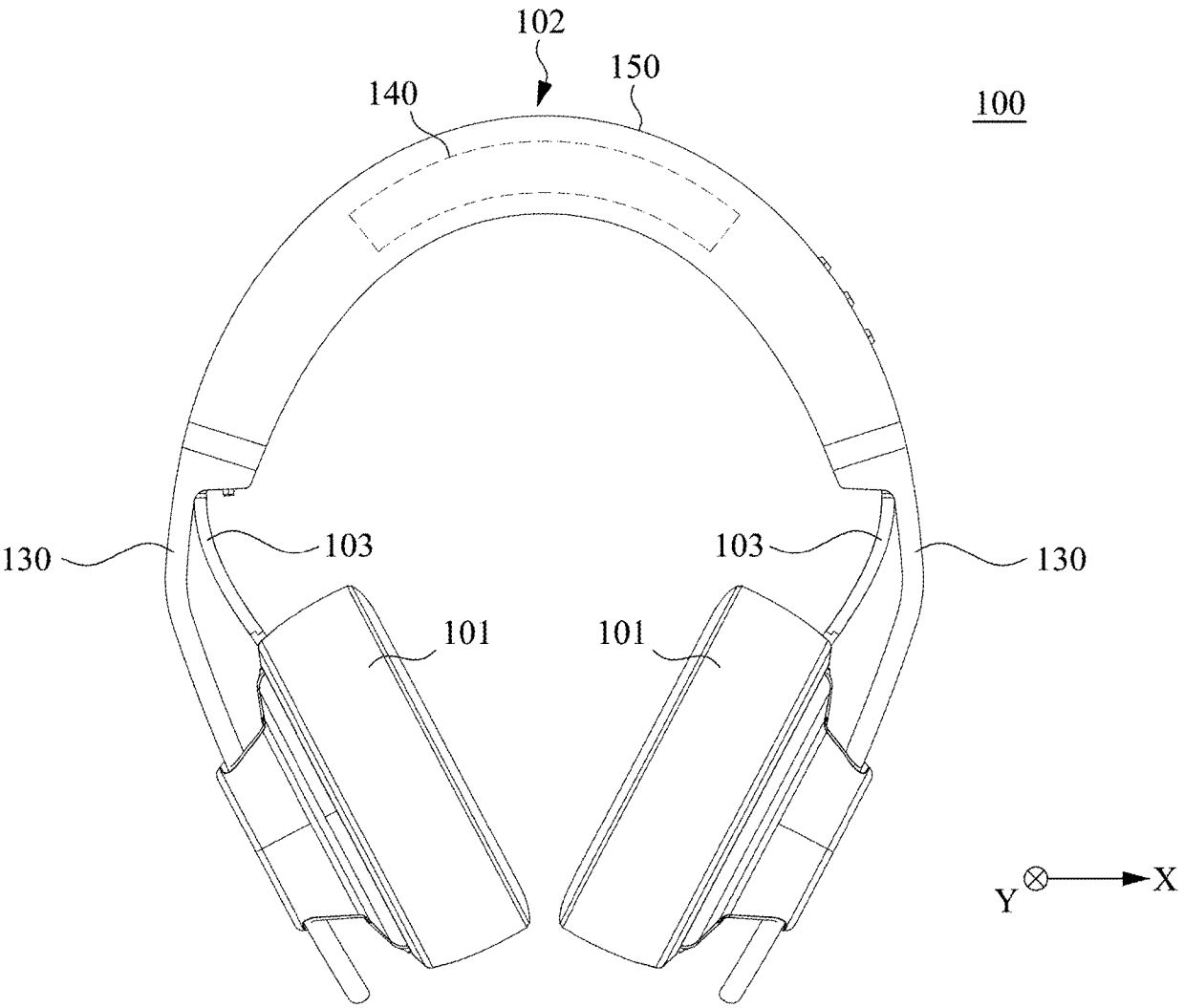
FIG. 1 illustrates a front view of a headphone in accordance with an embodiment of the present disclosure.

For the completeness of the description of the present disclosure, reference is made to the accompanying drawings and the various embodiments described below. Various features in the drawings are not drawn to scale and are provided for illustration purposes only. To provide full understanding of the present disclosure, various practical details will be explained in the following descriptions. However, a person with an ordinary skill in relevant art should realize that the present disclosure can be implemented without one or more of the practical details. Therefore, the present disclosure is not to be limited by these details.

Reference is made to FIG. 1, which illustrates a front view of a headphone 100 in accordance with an embodiment of the present disclosure. The headphone 100 includes two audio output devices 101 and a headband 102. The two audio output devices 101 are arranged in a first direction X. The headband 102 is arc-shaped and is connected between the two audio output devices 101. The headband 102 is configured to support the two audio output devices 101. In addition, the headband 102 is deformable, allowing the two audio output devices 101 to change their relative positions. For example, the headband 102 may be expanded laterally, allowing the two audio output devices 101 to be displaced in the first direction X. The headband 102 may also be twisted, allowing the two audio output devices 101 to be displaced in a second direction Y perpendicular to the first direction X.

As shown in FIG. 1, the headphone 100 further includes at least one electrical wire 103. The electrical wire 103 is electrically connected to the two audio output devices 101. Electronic signals such as audio signals may be transmitted to the two audio output devices 101 via the electrical wire 103.

As shown in FIG. 1, the headband 102 includes two arms 130 and a deformable structure 140 (shown in broken lines). The two arms 130 of the headband 102 are connected to the two audio output devices 101, respectively. The deformable structure 140 is connected between the two arms 130 to allow the two arms 130, and thus the two audio output devices 101 connected thereto, to change their relative positions. In some embodiments, the headband 102 further includes a protective covering 150. The protective covering 150 wraps around the deformable structure 140 and part of the two arms 130.

Figure 2:
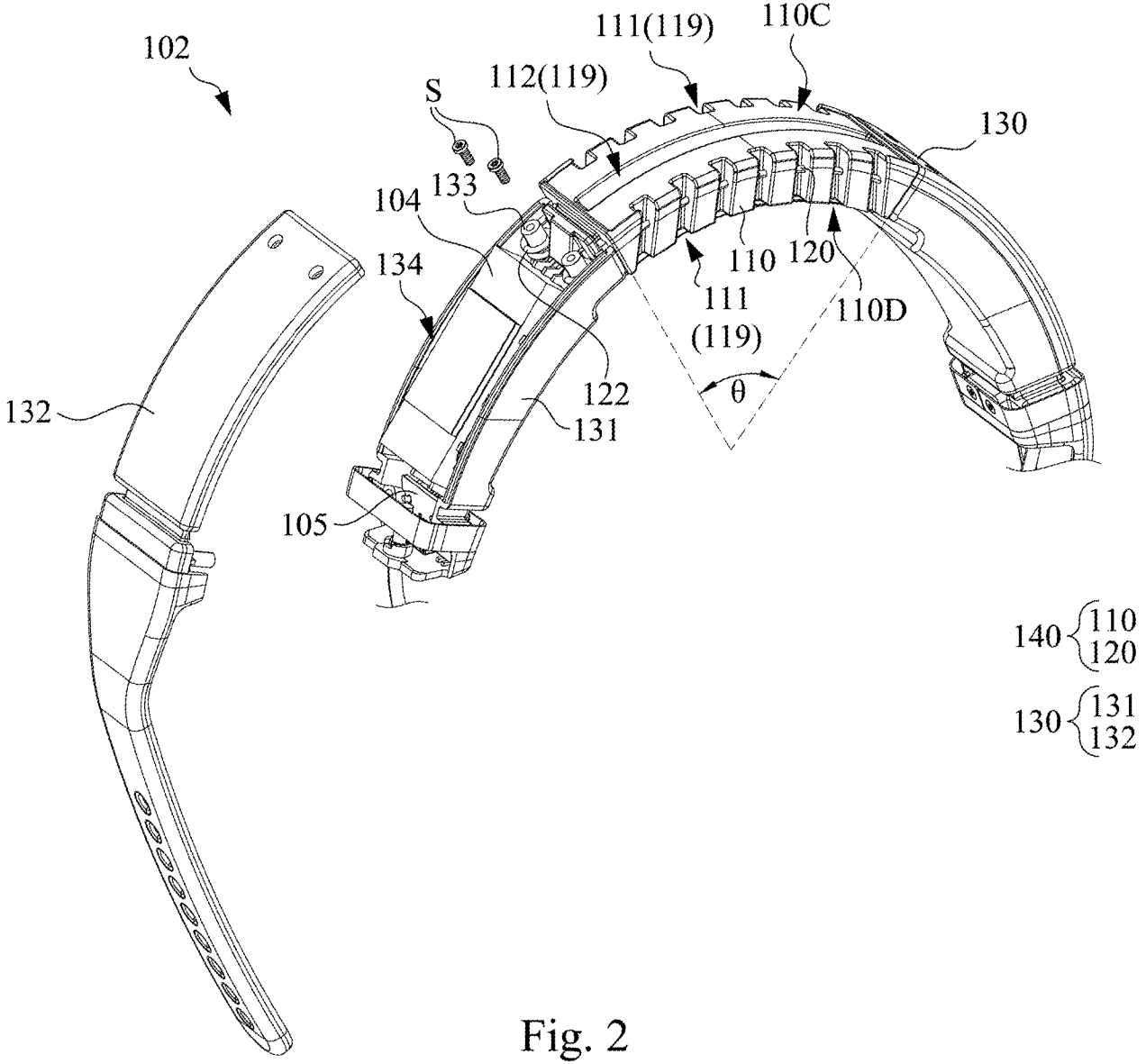
FIG. 2 illustrates an exploded view of the headband of the headphone shown in FIG. 1.
Figure 3:
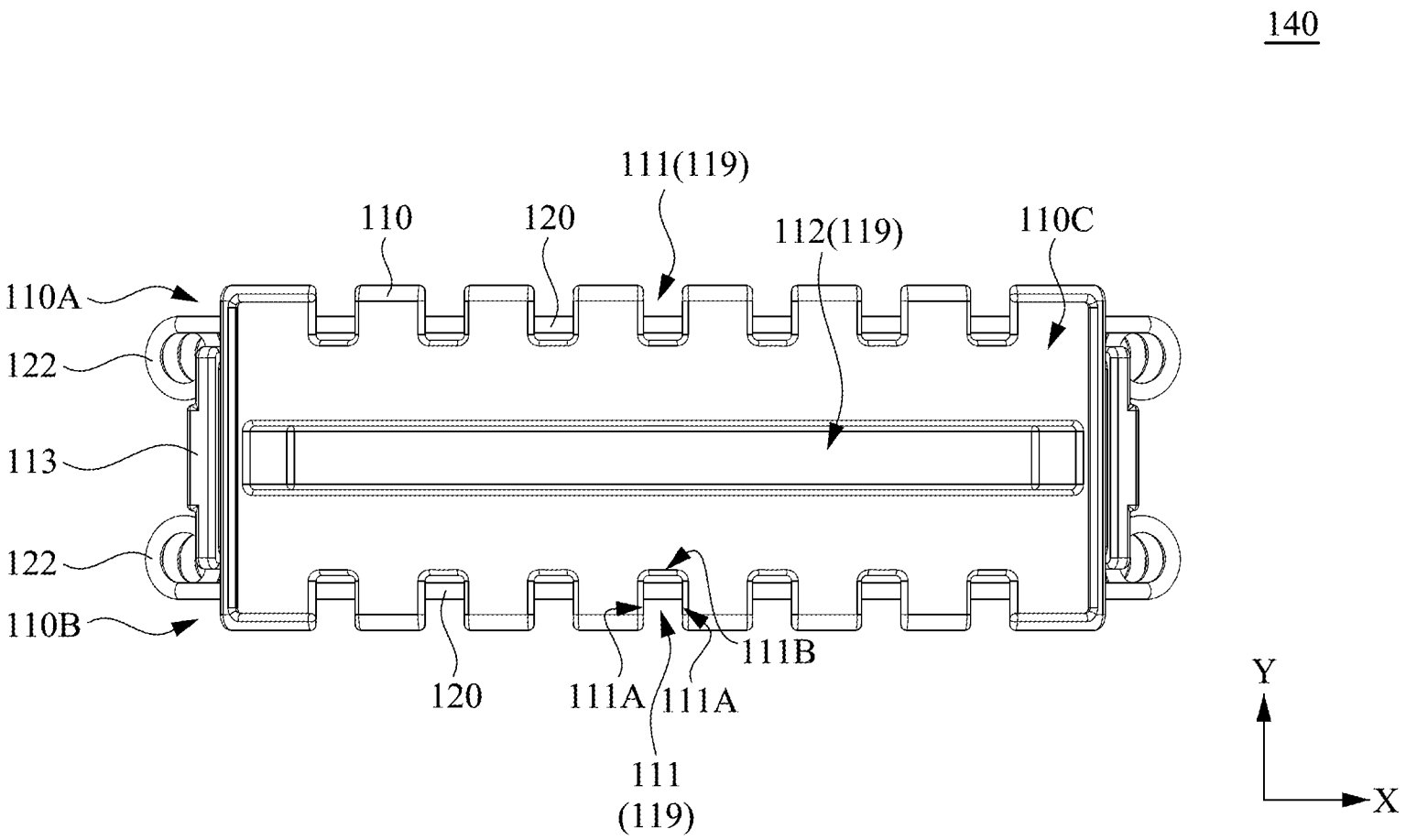
FIG. 3 illustrates a top view of some components of the headband shown in FIG. 2.

Reference is made to FIGS. 2 and 3. FIG. 2 illustrates an exploded view of the headband 102 of the headphone 100 shown in FIG. 1. FIG. 3 illustrates a top view of some components of the headband 102 shown in FIG. 2. The deformable structure 140 includes a rubber block 110 and at least one shape memory alloy wire 120 which is at least partially embedded in the rubber block 110. In the present embodiment, the shape memory alloy wire 120 extends through the rubber block 110, and the two ends of the shape memory alloy wire 120 are both exposed outside the rubber block 110.

The flexibility of the rubber block 110 makes the headband 102 of the headphone 100 twistable. And with the aid of the shape memory alloy wire 120 embedded in the rubber block 110, the headband 102 can easily restore to its original shape when the external force exerted on the headband 102 is removed. In addition, the combination of the rubber block 110 and the shape memory alloy wire 120 provides moderate stiffness. Accordingly, when the user wears the headphone 100, the headphone 100 would not put too much pressure on the user's head.

In some embodiments, the rubber block 110 includes rubber with 70A Shore hardness, and the shape memory alloy wire 120 include Nickel-Titanium alloy to provide desirable twistability and restoring ability. In some embodiments, the arms 130 are made of plastic. In some embodiments, the arms 130 include TR90 material.

As shown in FIGS. 2 and 3, in some embodiments, the rubber block 110 has an arc shape, and an angle θ spanned by the rubber block 110 (i.e., the angle between the two end surfaces of the rubber block 110 connected to the two arms 130) is substantially sixty degrees. By this arrangement, the headband 102 can better follow the shape of the user's head, resulting in an improvement in wearing comfort. Twistability and restoring ability of the headband 102 can also be improved by this arrangement. In some embodiments, the shape memory alloy wire 120 curvedly extends through the rubber block 110.

As shown in FIGS. 2 and 3, in some embodiments, the rubber block 110 has at least one cutout 119 (or recess). Forming the at least one cutout 119 on the rubber block 110 can not only promote stress dispersion when the headband 102 is twisted, but also reduce the weight of the headband 102.

As shown in FIGS. 2 and 3, in some embodiments, the rubber block 110 has a first edge 110A and a second edge 110B opposite to the first edge 110A. The rubber block 110 has a plurality of cutouts 111 arranged symmetrically along the first edge 110A and the second edge 110B of the rubber block 110, such that stress can be more effectively dispersed when the headband 102 is twisted. In some embodiments, the cutouts 111 are identical in size.

As shown in FIGS. 2 and 3, in some embodiments, the headband 102 includes two shape memory alloy wires 120. One of the two shape memory alloy wires 120 passes through one or more of the cutouts 111 at the first edge 110A, while the other passes through one or more of the cutouts 111 at the second edge 110B. By this arrangement, the cutouts 111 can provide moving freedom for the shape memory alloy wires 120, such that the headband 102 can be more easily twisted. This arrangement can also reduce the clamping force applied to the user's head by the headphone 100, and thus the wearing comfort of the headphone 100 can be improved.

As shown in FIGS. 2 and 3, in some embodiments, each of the cutouts 111 has two side surfaces 111A and a bottom surface 111B connected between the two side surfaces 111A. The shape memory alloy wires 120 pass through the two side surfaces 111A and are spaced apart from the bottom surface 111B. In other words, the rubber block 110 does not abut against the sections of the shape memory alloy wires 120 that pass through the cutouts 111, making the shape memory alloy wires 120 less likely to rupture when the headband 102 is twisted.

As shown in FIGS. 2 and 3, the rubber block 110 has a first surface 110C and a second surface 110D opposite to the first surface 110C. The first surface 110C and the second surface 110D are both located between the first edge 110A and the second edge 110B. The first surface 110C are away from the two audio output devices 101, while the second surface 110D faces the two audio output devices 101. In some embodiments, the rubber block 110 further has at least one cutout 112 formed on the first surface 110C. The cutout 112 recesses from the first surface 110C and extends between the one or more of the cutouts 111 at the first edge 110A and the one or more of the cutouts 111 at the second edge 110B.

Although the rubber block 110 is exemplified as having both the cutouts 111 and the cutout 112, the present disclosure is not limited thereto. In other embodiments, the rubber block 110 may be formed with either the cutouts 111 or the cutout 112. Forming either the cutouts 111 or the cutout 112 on the rubber block 110 can also promote stress dispersion and achieve weight reduction.

As shown in FIGS. 2 and 3, in some embodiments, the arm 130 includes at least one post 133. The shape memory alloy wire 120 includes at least one curled portion 122. The curled portion 122 is at an end of the shape memory alloy wire 120 and is exterior to the rubber block 110. The curled portion 122 is fixedly wound on the post 133. In some embodiments, the curled portion 122 has a helical shape.

As shown in FIGS. 2 and 3, in some embodiments, the arm 130 includes a first housing component 131 and a second housing component 132. The first housing component 131 and the second housing component 132 may be combined via screws or other fasteners to form the arm 130. The post 133 is disposed on the first housing component 131 and has a screw hole. A screw S is arranged to pass through the second housing component 132 and screw into the screw hole of the post 133. In this way, the second housing component 132 can be fixedly attached to the first housing component 131.

As shown in FIGS. 2 and 3, in some embodiments, the arm 130 has an accommodating space 134 configured to house one or more electronic components. In some embodiments, the headphone 100 further includes a battery 104 disposed in the accommodating space 134 of the arm 130. In some embodiments, the headphone 100 further includes a circuit board 105 disposed in the accommodating space 134 of the arm 130.

Figure 4:
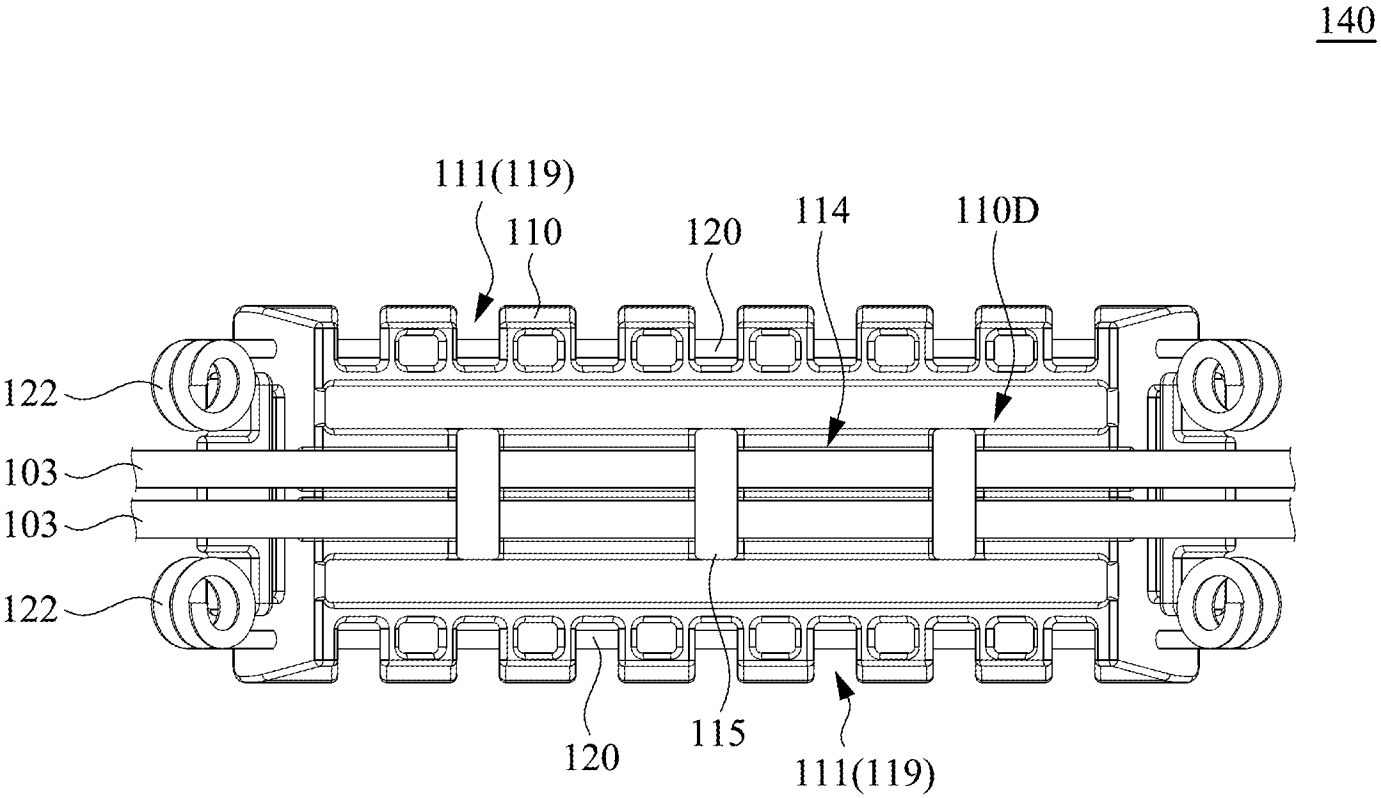
FIG. 4 illustrates a bottom view of some components of the headband shown in FIG. 2.
Figure 5:
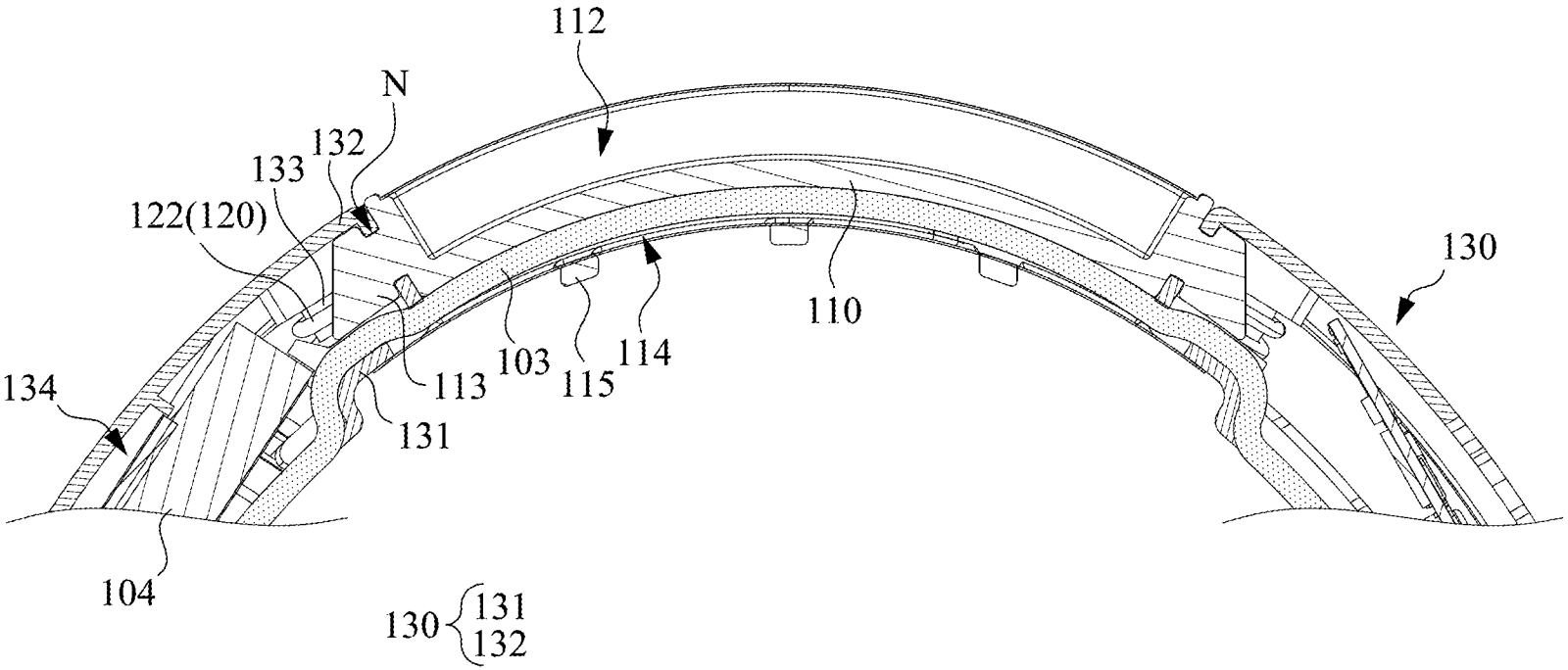
FIG. 5 illustrates an assembled, sectional view of the headband shown in FIG. 2.

Reference is made to FIGS. 4 and 5. FIG. 4 illustrates a bottom view of some components of the headband 102 shown in FIG. 2. FIG. 5 illustrates an assembled, sectional view of the headband 102 shown in FIG. 2. In some embodiments, the rubber block 110 further has at least one groove 114. The groove 114 is located on the second surface 110D of the rubber block 110. The electrical wire 103 of the headphone 100 is disposed in the groove 114. When the headband 102 is twisted, the electrical wire 103 disposed in the groove 114 is bent to follow the deformation of the rubber block 110.

Although the rubber block 110 is exemplified as having both the cutout 112 and the groove 114, the present disclosure is not limited thereto. In other embodiments, the rubber block 110 has at least one cutout or groove on one of its surfaces (the first surface 110C or the second surface 110D), which can receive the electrical wire 103, and at the same time, promote stress dispersion and achieve weight reduction.

As shown in FIGS. 4 and 5, in some embodiments, before the electrical wire 103 is fitted into the groove 114, the width of the groove 114 is less than the width of the electrical wire 103. As a result of that, when the electrical wire 103 is fitted into the groove 114, the electrical wire 103 may be fixedly clamped in the groove 114. In some embodiments, the rubber block 110 includes at least one retaining structure 115 extending across the groove 114. The electrical wire 103 is located between the retaining structure 115 and a bottom surface of the groove 114. The retaining structure 115 serves to prevent the electrical wire 103 from escaping from the groove 114 when the headband 102 is twisted.

As shown in FIGS. 4 and 5, in some embodiments, the rubber block 110 includes at least one protrusion 113 to be connected to the arm 130. Specifically, the protrusion 113 is located between the two shape memory alloy wires 120 and is fixedly inserted into the arm 130. The protrusion 113 can strengthen the connection between the deformable structure 140 and the arm 130. In addition, when the rubber block 110 is provided with the protrusion 113, no visible gap would be created between the rubber block 110 and the arm 130 when the headphone 100 is expanded, resulting in an improvement in the appearance of the product.

As shown in FIGS. 4 and 5, in some embodiments, the protrusion 113 of the rubber block 110 is clamped by the first and second housing components 131 and 132 of the arm 130. In some embodiments, the protrusion 113 has a neck portion N, and the arm 130 engages the neck portion N. In some embodiments, the electrical wire 103 passes through a side of the protrusion 113 and extends into the interior of the arm 130.

Figure 6:
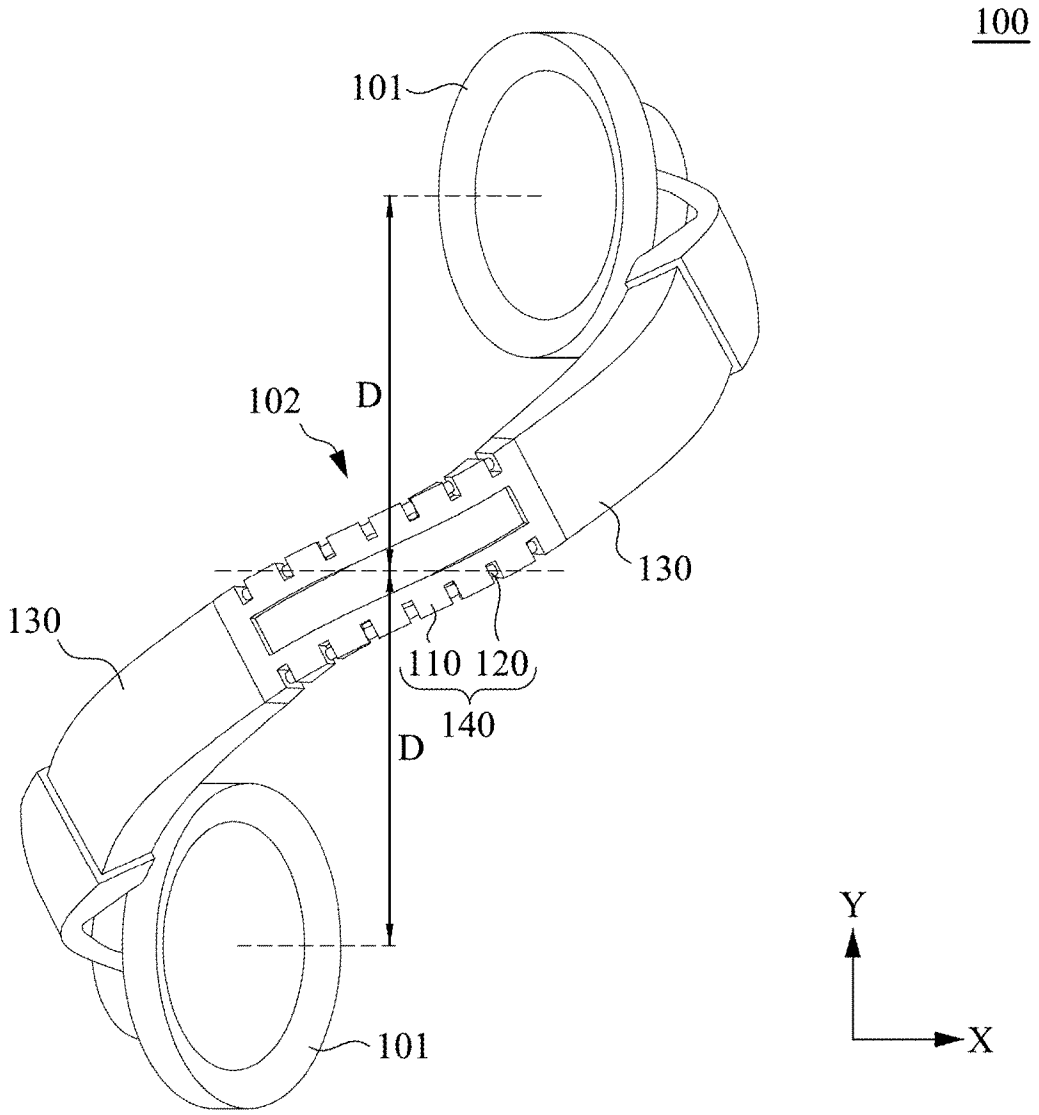
FIG. 6 schematically illustrates the headphone of FIG. 1 being twisted.

Reference is made to FIG. 6, which schematically illustrates the headphone 100 of FIG. 1 being twisted. By virtue of the structure arrangements discussed above, when the two audio output devices 101 are displaced in the second direction Y, the rubber block 110 of the headband 102 and the shape memory alloy wire 120 embedded in the rubber block 110 are twisted to connect the two shifted arms 130. When the external force causing the twisting of the headband 102 is removed, the headband 102 can restore to the shape shown in FIG. 1 by virtue of the elasticity of the rubber block 110 and with the aid of the shape memory alloy wire 120. The shape memory alloy wire 120 exhibits "memory" property, which can improve the durability of the headband 102, i.e., the headband 102 can successfully restore to its original shape after a large number of twists. In some embodiments, the twisted headband 102 has a maximum extension length D (i.e., the maximum displacement of the audio output device 101 that can be supported by the headband 102) of 3.5 inches for one side.

In sum, the headphone of the present disclosure is featured with a headband including a rubber block and at least one shape memory alloy wire at least partially embedded in the rubber block. This arrangement can provide advantages such as making the headband more easily twistable and restorable, and reducing the pressure applied to the user's head by the headphone to improve wearing comfort.

Although the present disclosure has been described by way of the exemplary embodiments above, the present disclosure is not to be limited to those embodiments. Any person skilled in the art can make various changes and modifications without departing from the spirit and the scope of the present disclosure. Therefore, the protective scope of the present disclosure shall be the scope of the claims as attached.

What is claimed is:

1. A headphone, comprising:

two audio output devices; and a headband connected between the two audio output devices, the headband comprising a rubber block and at least one shape memory alloy wire, wherein the shape memory alloy wire is at least partially embedded in the rubber block, and wherein the rubber block has at least one first cutout;

wherein the at least one first cutout is plural in number, the first cutouts are arranged symmetrically along a first edge and a second edge of the rubber block, wherein the second edge of the rubber block is opposite to the first edge of the rubber block.

2. The headphone of claim 1, wherein the at least one shape memory alloy wire comprises a first shape memory alloy wire and a second shape memory alloy wire, the first shape memory alloy wire passes through one or more of the first cutouts at the first edge, and the second shape memory alloy wire passes through one or more of the first cutouts at the second edge.

3. The headphone of claim 2, wherein each of the first cutouts has two side surfaces and a bottom surface connected between the two side surfaces, the first and second shape memory alloy wires pass through the two side surfaces and are spaced apart from the bottom surface.

4. The headphone of claim 1, wherein the rubber block further has a second cutout, the second cutout is formed on a surface of the rubber block between the first edge and the second edge.

5. The headphone of claim 1, further comprising an electrical wire, wherein the rubber block further has a groove, the groove is located on a surface of the rubber block facing the two audio output devices, and the electrical wire is disposed in the groove.

6. The headphone of claim 5, wherein the rubber block comprises a retaining structure extending across the groove.

7. A headphone, comprising:

two audio output devices; and a headband connected between the two audio output devices, the headband comprising a rubber block and at least one shape memory alloy wire, wherein the shape memory alloy wire is at least partially embedded in the rubber block, and wherein the rubber block has at least one first cutout;

wherein the headband further comprises an arm, the arm comprises a post, the shape memory alloy wire comprises a curled portion exterior to the rubber block and fixedly wound on the post.

8. The headphone of claim 7, wherein the rubber block comprises a protrusion fixedly inserted into the arm.

9. The headphone of claim 8, wherein the arm comprises a first housing component and a second housing component, the protrusion of the rubber block is clamped by the first and second housing components.

* * * * *